US006529578B1

(12) United States Patent
Taguchi et al.

(10) Patent No.: US 6,529,578 B1
(45) Date of Patent: Mar. 4, 2003

(54) X-RAY CONDENSER AND X-RAY APPARATUS

(75) Inventors: Takeyoshi Taguchi, Tokyo (JP); Katsuhiko Ogiso, Tokyo (JP)

(73) Assignee: Rigaku Corporation, Akishima (JP)

( * ) Notice: Subject to any disclaimer, the term of this patent is extended or adjusted under 35 U.S.C. 154(b) by 0 days.

(21) Appl. No.: 09/670,572

(22) Filed: Sep. 27, 2000

(30) Foreign Application Priority Data

Oct. 1, 1999 (JP) ..... 11-281122

(51) Int. Cl.[7] ..... G21K 1/06
(52) U.S. Cl. ..... 378/84; 378/43; 378/119
(58) Field of Search ..... 378/84, 43, 119

(56) References Cited

U.S. PATENT DOCUMENTS 4,870,674 A * 9/1989 Schmahl et al. ..... 378/43
5,204,887 A * 4/1993 Hayashida et al. ..... 378/43
5,550,887 A * 8/1996 Schmal et al. ..... 378/43
5,590,168 A * 12/1996 Iketaki ..... 378/43
6,167,112 A * 12/2000 Schneider ..... 378/43
6,259,764 B1 * 7/2001 Evans-lutterodt et al. ..... 378/84
6,324,255 B1 * 11/2001 Kondo et al. ..... 378/119

FOREIGN PATENT DOCUMENTS

JP 8-128970 5/1996

* cited by examiner

*Primary Examiner*—David V. Bruce
*Assistant Examiner*—Pamela R. Hobden
(74) *Attorney, Agent, or Firm*—Burns, Doane, Swecker & Mathis, LLP

(57) ABSTRACT

An X-ray condenser for condensing X-rays radiated from an X-ray source to a very small condensing spot is disclosed. X-rays from the X-ray source are formed to a parallel X-ray beam by a parallel type parabolic reflection mirror. The parallel X-ray beam is made monochromatic by an analyzing crystal and condensed to the condensing spot by a zone plate. The zone plate is constructed by alternately arranging a plurality of X-ray transmitting bands and a plurality of X-ray shielding bands and can condense the parallel X-ray beam to a very small focus point.

14 Claims, 6 Drawing Sheets

X-RAY CONDENSER AND X-RAY APPARATUS

BACKGROUND OF THE INVENTION

1. Field of the Invention

The present invention relates to an X-ray condenser for condensing X-ray diverging from an X-ray source to a small point, which is suitable for use in an X-ray diffraction apparatus such as an X-ray micro-diffraction apparatus or an X-ray microscope for measuring X-ray diffraction by irradiating a very small region of a sample or a very small sample with X-ray. Further, the present invention relates to an X-ray apparatus constructed with the same X-ray condenser.

2. Description of the Related Art

In an X-ray micro-diffraction apparatus, a micro-area of a sample, etc., is irradiated with an X-ray beam having very small cross sectional diameter and an X-ray information such as diffracted X-ray information, from the sample existing in a field of the irradiation is measured by an X-ray detector. On the other hand, in an X-ray microscope, values of X-ray absorption at discrete positions of a sample under measurement is measured by scanning the sample with an X-ray beam having small cross sectional diameter and detecting intensities of the X-ray transmitted at the respective positions of the sample by an X-ray detector.

In the X-ray apparatus such as the X-ray micro-diffraction apparatus or the X-ray microscope, mentioned above, it is necessary to irradiate a micro-area of a sample with an X-ray, which diverges from an X-ray source and is, preferably, converged on said micro-area. An X-ray condenser is used to converge, namely condense, the diverging X-ray. An example of the X-ray condenser is disclosed in Japanese Patent Application Laid-open No. H8-128970. The disclosed X-ray condenser utilizes an inner surface of a cylinder as an X-ray reflecting mirror and X-ray is condensed to a micro-area by making the inner surface of the cylinder curved.

The disclosed X-ray condenser has a very simple construction and can condense relatively intense X-ray to a micro-area. However, there is a limit in reducing the cross sectional diameter of condensed X-ray. For example, it is very difficult for the disclosed X-ray condenser to reduce the diameter of irradiation area to a value smaller than 10 $\mu$m.

SUMMARY OF THE INVENTION

An object of the present invention is to provide an X-ray condenser capable of condensing X-ray to a very small spot.

Another object of the present invention is to provide an X-ray apparatus capable of performing an X-ray measurement with very high spatial resolution.

According to the present invention, in order to achieve the above mentioned objects, an X-ray condenser for condensing X-ray radiated from an X-ray source to a micro spot is featured by comprising parallel beam forming means for collimating a diverging X-ray from the X-ray source to a parallel X-ray beam and a zone plate disposed in a downstream side of the parallel beam forming means in a propagating direction of the X-ray and constructed by alternately arranging X-ray transmitting bands and X-ray shielding bands.

The zone plate is an X-ray optical component for condensing parallel X-ray beam to a point remote from it by a specific focal distance. Therefore, when a parallel X-ray beam is formed by the parallel beam forming means and the parallel X ray beam is incident on the zone plate, it is possible to condense the X-ray to a micro spot having diameter smaller than 10 $\mu$, which was impossible by the conventional X-ray condenser.

For example, as shown in FIGS. 4(*a*) and 4(*b*), the zone plate 11 may be formed by alternately arranging X-ray transmitting bands 12, which allow X-ray to pass through, and X-ray shielding bands 13, which do not allow X-ray to pass through. In the structure of the zone plate shown in FIGS. 4(*a*) and 4(*b*), the X-ray transmitting bands 12 and the X-ray shielding bands 13 are circular. The zone plate 11 can be manufactured by forming the X-ray shielding bands 13, which is patterned in a predetermined manner, on an X-ray transparent substrate 14 by a suitable patterning method such as photolithography. In such case, the X-ray transmitting bands 12 are formed by portions of the X-ray transparent substrate 14, which exist between adjacent X-ray shielding bands.

The X-ray transparent substrate 14 may be formed of, for example, silicon nitride ($Si_3N_4$) or boron nitride (BN). The X-ray shielding bands 13 may be formed of, for example, gold (Au), tantalum (Ta) or nickel (Ni). The number of zones each including a pair of the X-ray transmitting band and the X-ray shielding band is set to, for example, in the order of 300 to 400.

Since the index of refraction of electromagnetic wave in X-ray region is close to "1", X-ray cannot be focused by using an optical lens for a visible light. The zone plate is used in X-ray region as a substitution for the optical lens. The zone plate takes in the form of, for example, a circular diffraction lattice with which X-ray can be focused. The zone plate having 100 or more zones can be treated in substantially the same manner as a lens used in a usual refractive optics.

In FIG. 4(*b*), X-ray R0 radiated from an X-ray source F passes through the X-ray transmitting bands 12 to a condensing spot P. Widths of the X-ray transmitting bands and the X-ray shielding bands are set such that an optical path length of X-ray passing the (m)th X-ray transmitting band is shifted from that passing through the (m+1)th X-ray transmitting band by a wavelength of the X-ray so that all X-ray beams reaching the condensing spot are intensified each other. Thus, the condensing spot P becomes equivalent to a focusing point of an optical lens.

Incidentally, in the present invention, the zone plate may be the so-called phase zone plate. That is, the usual zone plate utilizes the phenomenon that X-ray beams passed through the X-ray transmitting bands are intensified each other by interference so that the X-ray beams are focused. On the other hand, when the thickness of the X-ray shielding bands is reduced such that X-ray can pass therethrough with phase thereof being shifted by a half wavelength, X-ray passed the X-ray shielding bands and X-ray passed through the X-ray transmitting bands are intensified each other by interference to thereby increase the intensity of output X-ray. The zone plate having the latter property is called "phase zone plate".

In the X-ray condenser according to the present invention, it is preferable to provide spectrometry means capable of picking up X-ray component having a specific wavelength from X-ray containing a plurality of different wavelength components between the parallel beam forming means and the zone plate.

In general, there is the problem of chromatic aberration in the zone plate. That is, when parallel X-ray incident on the zone plate contains X-ray components having different wavelengths, the condensing spot of the X-ray is blurred correspondingly to the wavelength difference, so that it becomes difficult to form micro-X-ray beam having finely defined cross section. However, by monochromatisation of the X-ray incident on the zone plate by means of the spectrometry means, it is possible to reduce the chromatic aberration to thereby prevent the X-ray condensing spot from being blurred.

The spectrometry means is not limited to a spectroscope having a specific structure or to a substance having a specific structure. For example, the spectrometry means may be constructed with using analyzing crystal.

In the X-ray condenser according to the present invention, the parallel beam forming means may be parabolic parallel beam forming means in which diverging beams are made parallel either in horizontal or vertical direction, by utilizing a parabolic surface. By utilizing such parabolic surface, it is possible to form exactly parallel X-ray beams with a simple construction.

In the X-ray condenser according to the present invention, the parallel beam forming means may be parabolic parallel beam forming means in which diverging beams are made parallel both in horizontal and vertical directions, by utilizing a parabolic surface. By forming parallel X-ray beams parallel both in the horizontal and vertical directions by utilizing such parabolic surface, it is possible to form more intense X-ray beam having rectangular cross section compared with the described construction for forming X-ray beam parallel in only one of the horizontal and vertical directions.

In the X-ray condenser according to the present invention, the parallel beam forming means may be constructed with a parabolic reflection mirror capable of reflecting X-ray by a parabolic surface or a multi-layered parabolic film mirror capable of reflecting X-ray by diffraction by a multi-layered film formed on a parabolic surface.

As shown in FIG. 2(*a*), the parabolic reflection mirror la may be formed by machining a surface of a member 2 of such material as glass or metal capable of reflecting X-ray to a parabolic surface H and mirror-finishing the parabolic surface H. Incidentally, the parabolic surface H has a suitable width and extends in a direction perpendicular to the plane of FIG. 2(*a*).

Alternatively, as shown in FIG. 2(*b*), the parabolic reflection mirror 1*b* may be formed by machining a surface of a substrate 3 of such material as glass, metal or resin to a smooth parabolic mirror surface H and forming a reflection film 4 of metal on the smooth parabolic mirror surface H. In such case, the metal reflection film 4 may be formed of Au, Ni or platinum (Pt). As the forming method of the metal reflection film 4, any known film forming method, for example, vapor-deposition or sputtering, may be used. Incidentally, the parabolic surface H has a suitable width and extends in a direction perpendicular to the plane of FIG. 2(*b*).

In the parabolic reflection mirror 1*a* shown in FIG. 2(*a*) and the parabolic reflection mirror 1*b* shown in FIG. 2(*b*), the X-ray source F is positioned at a focal point of a reflection surface of the parabolic reflection mirror 1*a* and 1*b*, that is, the parabolic surface H. Therefore, when X-ray R0 diverging from the X-ray source F is incident on the reflection surface of the parabolic reflection mirror 1*a* and 1*b*, the X-ray R0 is reflected, in more detail, fully reflected by the parabolic surface H as parallel X-ray beam As the method for forming the parallel X-ray beam, a collimator utilizing a slit or a pinhole has been known widely. In such conventional method, however, it is difficult to form intense parallel X-ray beam with high degree of parallelism. On the contrary, according to the present method using the parabolic reflection mirror 1*a* or 1*b*, it is possible to form intense parallel X-ray beam with high degree of parallelism.

On the other hand, as shown in FIG. 3, the multi-layered parabolic film mirror 6 can be formed by machining a surface of a substrate 3 to a smooth parabolic mirror surface H and forming a multi-layered film 7 on the smooth parabolic mirror surface H. The substrate 3 may be formed of, for example, single crystal of silicon (Si) or stainless steal.

The multi-layered film 7 is formed under condition that a plurality of heavy element layers 8 and a plurality of light element layers 9 are laminated alternately and a surface thereof on which diverging X-ray R0 from the X-ray source F is incident is the parabolic surface H. The formation of the respective layers may be performed by any suitable method, for example, sputtering.

By piling up a plurality of unit laminations each including the heavy element layer 8 and the light element layer 9, periodically, it is possible to diffract a specific X-ray, for example, CuK $\alpha$ ray, efficiently. As a result, it becomes possible to obtain intense X-ray at an output side of the parallel beam forming means. Further, by forming the surface of the multi-layered film 7 as the parabolic surface H, it is possible to diffract, that is, reflect incident X-ray on the whole surface to parallel directions to thereby obtain exactly parallel beams. In other words, very intense monochromatic parallel X-ray beam can be obtained by using the multi-layered parabolic film mirror 6.

When X-ray is to be fully reflected, it is necessary to direct incident X-ray at a small angle with respect to all reflection surfaces, that is, to reduce glancing angle. Therefore, intensity of X-ray to be condensed may be reduced. However, since it is possible to set the glancing angle to a large value in the multi-layered film 7 designed to diffract X-ray at the parabolic surface, it is possible to collect intense X-ray at the condensing spot.

Incidentally, in order to diffract X-ray in the respective layers, thickness t1 of the unit lamination of the heavy element layer 8 and the light element layer 9, that is, thickness of the unit lamination for one period, on the X-ray incident side is smaller than thickness t2 of the unit lamination on the X-ray output side. For example, t1 and t2 may be set to t1≈30 Å and t2≈40 Å.

As the heavy element, for example, tungsten (W), etc., may be considered and the light element may be, for example, Si, carbon (C) or boron carbide ($B_4C$), etc. Incidentally, the number of layers of the unit lamination is not limited to 2. For example, 3 layers or more of different elements may be included in the unit lamination.

In the X-ray condenser according to the present invention, in which diverging X-ray is made parallel beams in both the horizontal and vertical directions by the parallel beam forming means, it is preferable that the X-ray source is of the point focus type, X-ray from which has an area whose vertical width is substantially equal to horizontal width.

Alternatively, the X-ray source may be a line focus type, X-ray from which has an area whose horizontal width is larger than vertical width, or vice versa. However, when the line focus type X-ray source is used to make diverging X-ray parallel beams in both the horizontal and vertical directions, a resultant parallel beam is only a portion of the diverging X-ray and the remaining X-ray is not formed to parallel beam and consumed uselessly. On the contrary, when the point focus type X-ray source is used for the same purpose, it is possible to form diverging X-ray to parallel beams in both directions effectively.

In the X-ray condenser according to the present invention, it is preferable to provide a casing for air-tightly defining a space from the parallel beam forming means to the zone plate and evacuation means for discharging air out of the casing.

When the casing is evacuated by the evacuation means, it is possible to prevent X-ray condensed through the parallel beam forming means and the zone plate from being attenuated by air scattering to thereby condense intense X-ray to a micro spot. The evacuation means can be constructed by, such as a device for drawing air within the casing to reduce internal pressure thereof or a device for replacing air within the casing with helium.

An X-ray apparatus according to the present invention, which includes an X-ray source for radiating X-ray, an X-ray condenser for condensing X-ray from the X-ray source to a micro spot or a micro specimen and X-ray detection means for detecting X-ray from the specimen, is featured by that the X-ray condenser is constructed with the above-mentioned components. As the X-ray apparatus, an X-ray micro-diffraction apparatus or an X-ray microscope may be considered for example.

According to this X-ray apparatus, intense X-ray can be condensed in a very small area having diameter of, for example, 10 $\mu$m or less without blur, so that it is possible to irradiate a very small portion of a specimen or a very small specimen with intense and well defined beam to thereby obtain a result of measurement highly reliably with high spatial resolution.

DETAILED DESCRIPTION OF THE PREFERRED EMBODIMENTS

First Embodiment

Figure 1:
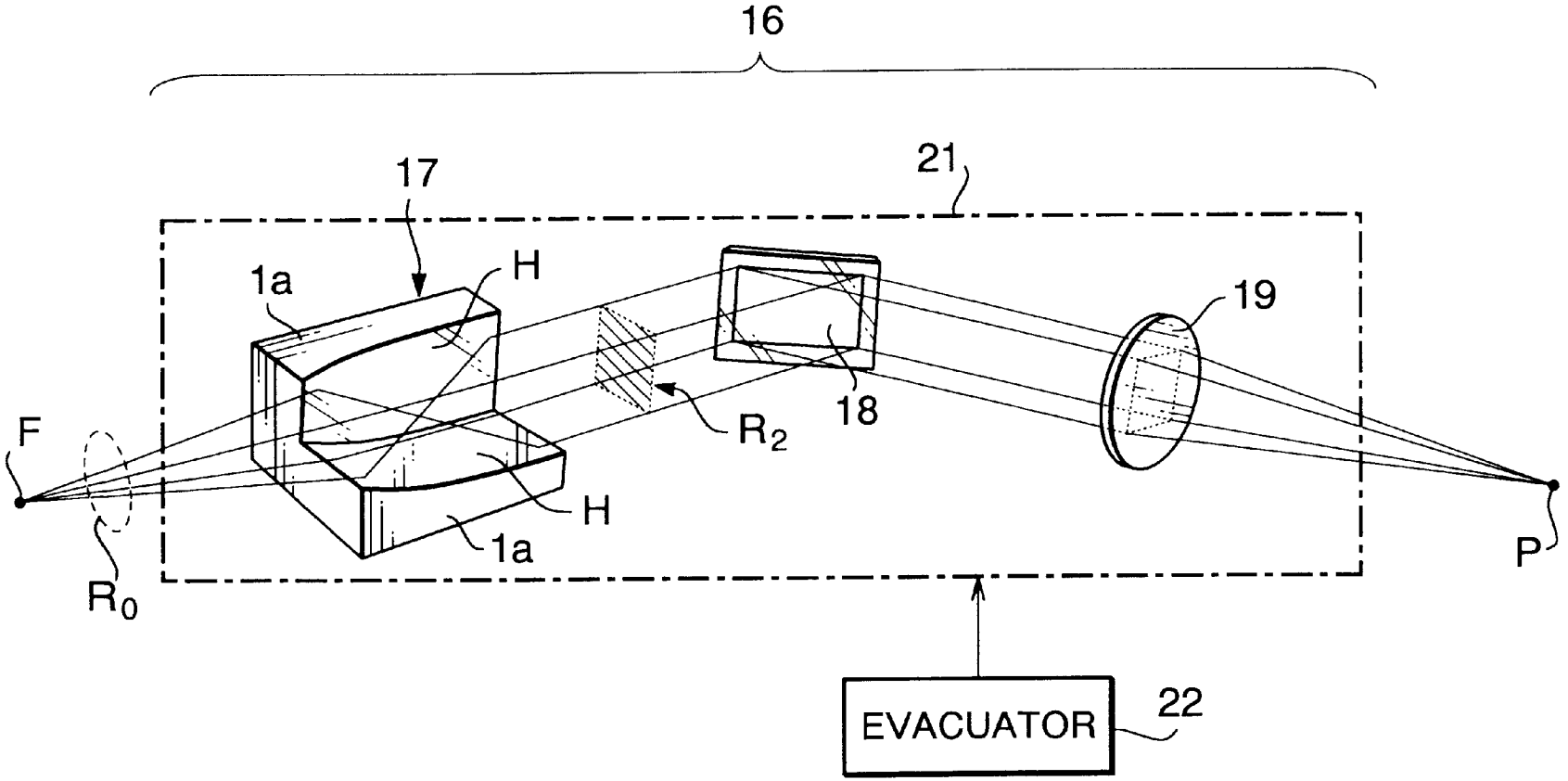
FIG. 1 is a perspective view of an embodiment of an X-ray condenser according to the present invention.

FIG. 1 shows an embodiment of an X-ray condenser according to the present invention. In FIG. 1, the X-ray condenser 16 includes an air-tight casing 21, in which a parallel type parabolic reflection mirror 17 functioning as parallel beam forming means as well as parabolic parallel beam forming means, an analyzing crystal 18 as spectrometry means and a zone plate 19 are arranged, and an evacuator 22 for evacuating an interior of the casing 21.

The casing 21 is formed of a structural material such as, for example, stainless steal which has sufficient mechanical strength and, preferably, easiness of machining. Although the casing 21 is shown in FIG. 1 as a rectangular box defined by a chain line, its configuration is selected suitably for the respective optical components contained therein and the arrangement thereof.

Figure 2A:
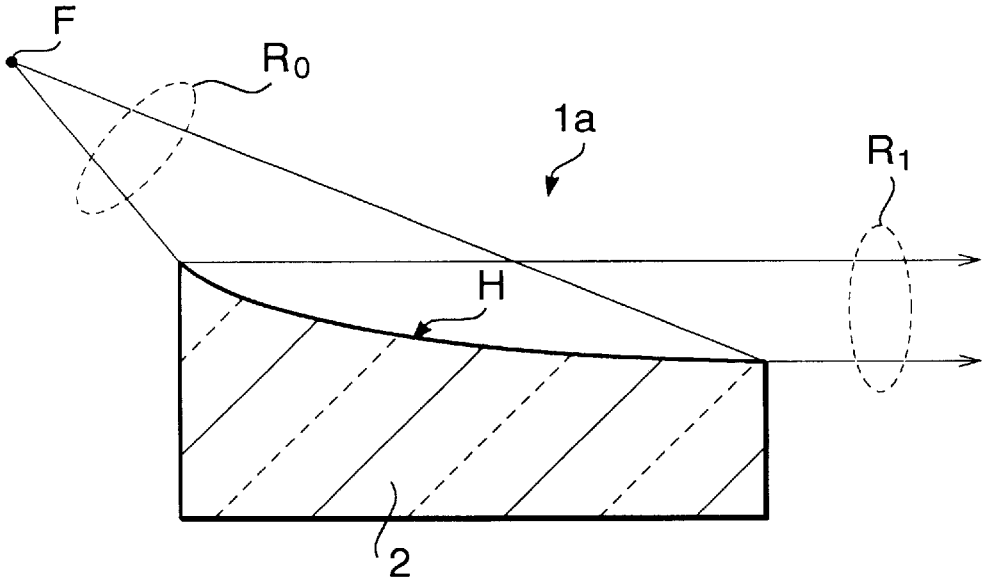
FIGS. 2(*a*) and 2(*b*) are cross sections of embodiments of a parabolic reflection mirror, which is an example of a parallel beam forming means of the X-ray condenser shown in FIG. 1, in which FIG. 2(*a*) shows the parabolic reflection mirror constructed with only an X-ray reflecting member and FIG. 2(*b*) shows the parabolic reflection mirror constructed with a substrate and a metal reflection film formed thereon.
Figure 2B:
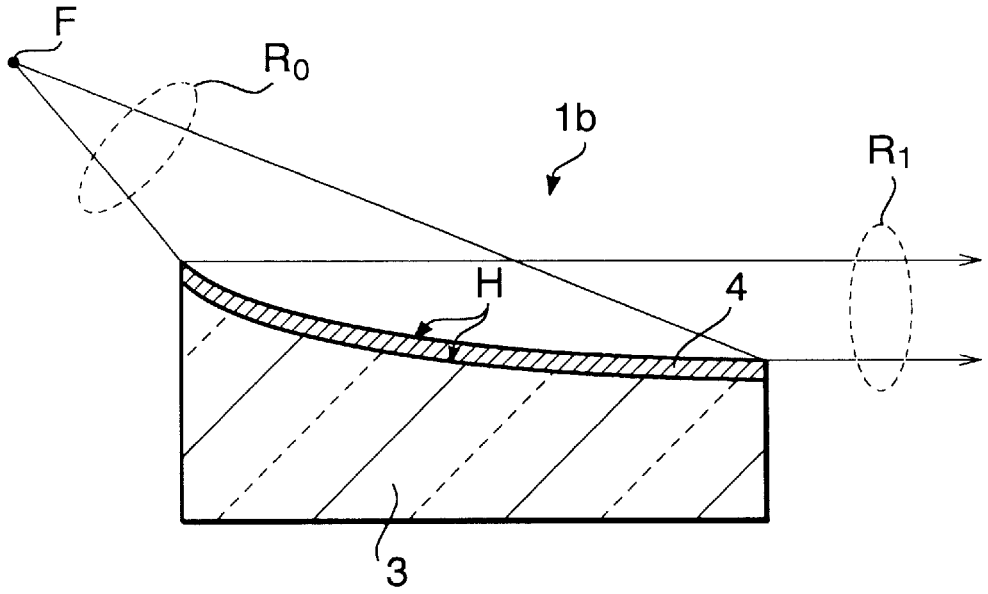

The parallel type parabolic reflection mirror 17 is constructed by juxtaposing a pair of parabolic reflection mirrors 1*a* each shown in FIG. 2(*a*) and obtained by machining an X-ray reflection surface of a suitable member 2 to a parabolic surface H in such a way that the parabolic surfaces H make a right angle to each other. When a diverging X-ray R0 incident on the parallel type parabolic reflection mirror 17, horizontally and vertically diverging components of the X-ray R0 are made horizontally and vertically parallel beams, respectively, resulting in a parallel X-ray beam R2 having a rectangular cross section.

As well known, the analyzing crystal 18 functions to pick up only a specific wavelength component of X-ray containing a plurality of X-ray components having different wavelengths. A material of the analyzing crystal 18 is selected according to a wavelength of X-ray component to be picked up.

Figure 4A:
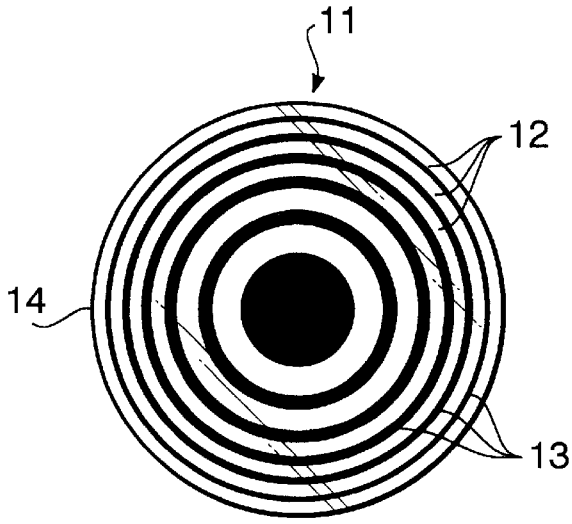
FIGS. 4(*a*) and 4(*b*) show an embodiment of a zone plate of the X-ray condenser shown in FIG. 1, in which FIG. 4(*a*) is a plan view thereof and FIG. 4(*b*) shows a portion of a cross section thereof.
Figure 4B:
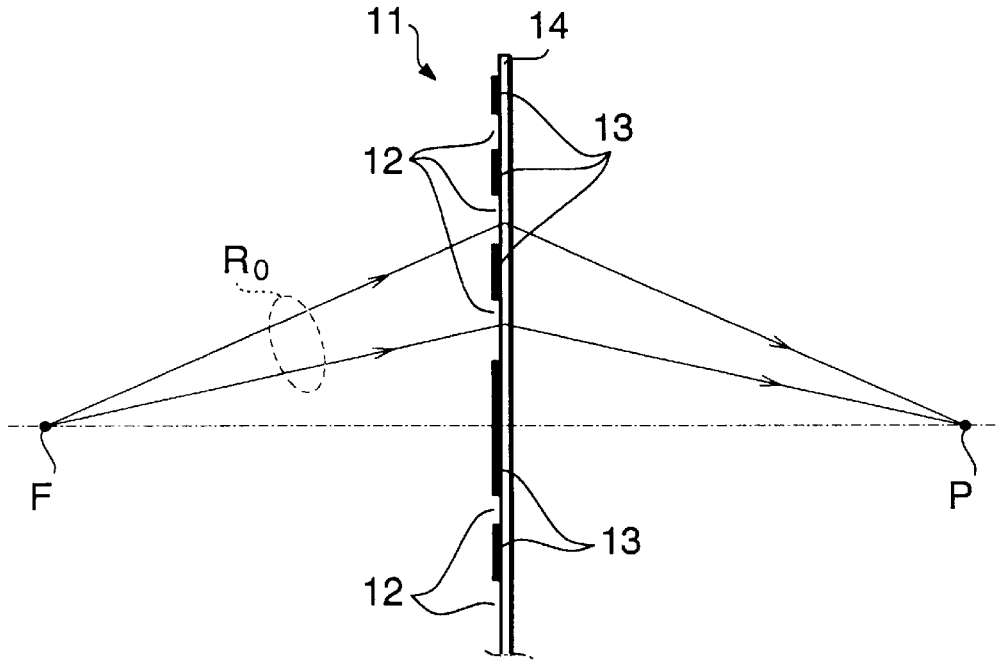

The zone plate 19 is constructed by alternately laminating X-ray transmitting bands 12 and X-ray shielding bands 13 as shown in FIGS. 4(*a*) and 4(*b*) and functions to condense an incident parallel X-ray beam to a small condensing spot P.

In the X-ray condenser 16 constructed as mentioned above, the diverging X-ray R0 from the X-ray source F is taken in the casing 21, which is evacuated by the evacuator 22. In this embodiment in which the parallel type parabolic reflection mirror 17 is used as the parallel beam forming means, it is preferable to use a point focus X-ray source for radiating X-ray from a substantially square focus spot as the X-ray source F.

Since the point focus X-ray source radiates X-ray diverging substantially uniformly in the horizontal and vertical directions, the diverging X-ray can be efficiently converted into parallel X-ray beam by the parallel type parabolic reflection mirror 17.

The X-ray taken in the casing 21 is shaped to the parallel X-ray beam R2 having the rectangular cross section by the parallel type parabolic reflection mirror 17 and incident on the analyzing crystal 18. The analyzing crystal 18 performs monochromatisation of the incident X-ray to pick up X-ray component having a specific wavelength and directs the monochromatic X-ray to the zone plate 19.

Since the zone plate 19 functions to condense parallel X-ray beams to a specific point, the monochromatic parallel X-ray beam incident on the zone plate 19 is condensed to the small condensing spot P. In this case, since X-ray received by the zone plate 19 is the exactly parallel X-ray formed by the parallel type parabolic reflection mirror 17, the size of the condensing spot P resulting from the zone plate 19 is substantially smaller than that achievable by the conventional condenser. According to the present X-ray condenser, it is possible to make the diameter of the condensing spot P as small as 10 $\mu$m or smaller, which cannot be achieved by the conventional condenser.

Further, in this embodiment, the parallel X-ray beam R2 formed by the parallel type parabolic reflection mirror 17 is made monochromatic by the analyzing crystal 18 and, then, the monochromatic X-ray is directed to the zone plate 19. Assuming that the X-ray incident on the zone plate 19 is continuous X-rays containing a plurality of X-ray components having different wavelengths, there may be blur in the condensing spot P formed by the zone plate 19 due to chromatic aberration, so that it becomes impossible to obtain a well defined condensing spot P having very small area. According to the present invention, however, the parallel X-ray beam incident on the zone plate 19 is made monochromatic by the analyzing crystal 18. Therefore, the influence of chromatic aberration can be reduced and, so, it is possible to obtain a well defined, very small condensing spot P.

Since the evacuator 22 discharges air out of the casing 21 in this embodiment, the X-ray is prevented from being reduced in intensity due to air scattering to thereby condense the intense X-ray to a micro spot.

In the embodiment shown in FIG. 1, the parallel type parabolic reflection mirror 17 having the structure including the horizontal and vertical parabolic reflection mirrors 1*a* arranged in parallel is employed as the parallel beam forming means. Instead thereof, it is possible to employ a structure including only one of the horizontal and vertical parabolic reflection mirrors 1*a*.

Figure 3:
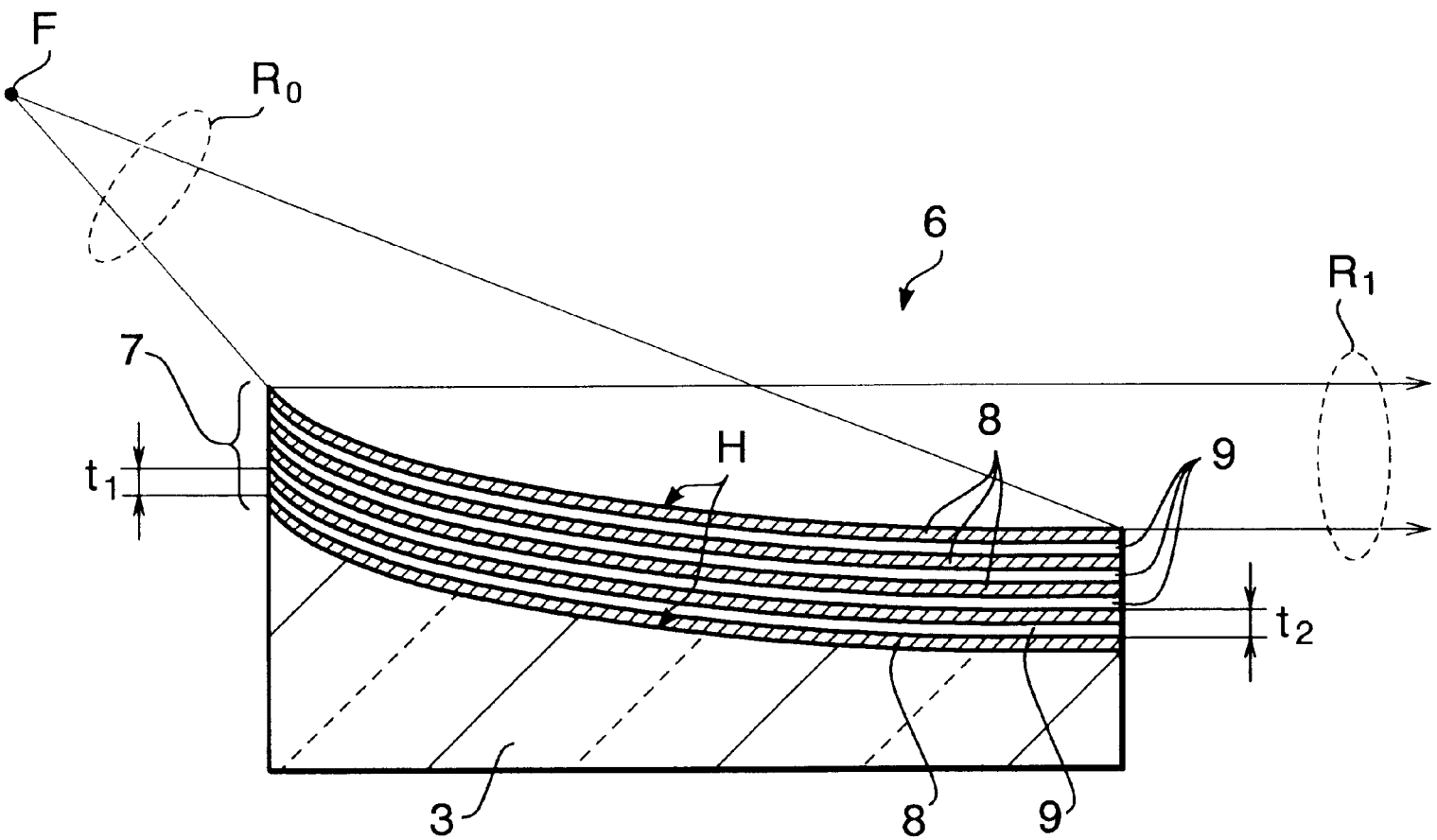
FIG. 3 is a cross section of an embodiment of a parabolic multi-layered film mirror, which is another example of the parallel bean forming means.

As the parallel beam forming means, it is possible to use the parabolic reflection mirror 1*b* shown in FIG. 2(*b*) instead of the parabolic reflection mirror 1*a* shown in FIG. 2(*a*). The parabolic reflection mirror 1*b* is constructed with the substrate 3 having a parabolic surface and a metal reflection film 4 formed on the parabolic surface. Alternatively, it is possible to employ a parabolic multi-layered mirror 6 shown in FIG. 3. The parabolic multi-layered mirror 6 is constructed with a substrate 3 having a parabolic surface and a multi-layered film 7 formed on the parabolic surface to reflect X-ray by diffraction.

Although, in the embodiment shown in FIG. 1, the analyzing crystal 18 is provided between the parallel type parabolic reflection mirror 17 and the zone plate 19, the analyzing crystal is not always necessary. Further, the evacuation of the casing 21, in which the X-ray path is defined, by means of the evacuator 22 is also not always necessary. The main purpose of the evacuator 22 is to remove air within the casing 21. Therefore, any other means such as a pressure regulator for discharging air or a helium displacing device for displacing air by helium may be used instead of the evacuator 22 so long as the purpose is achieved thereby.

Second Embodiment

Figure 5:
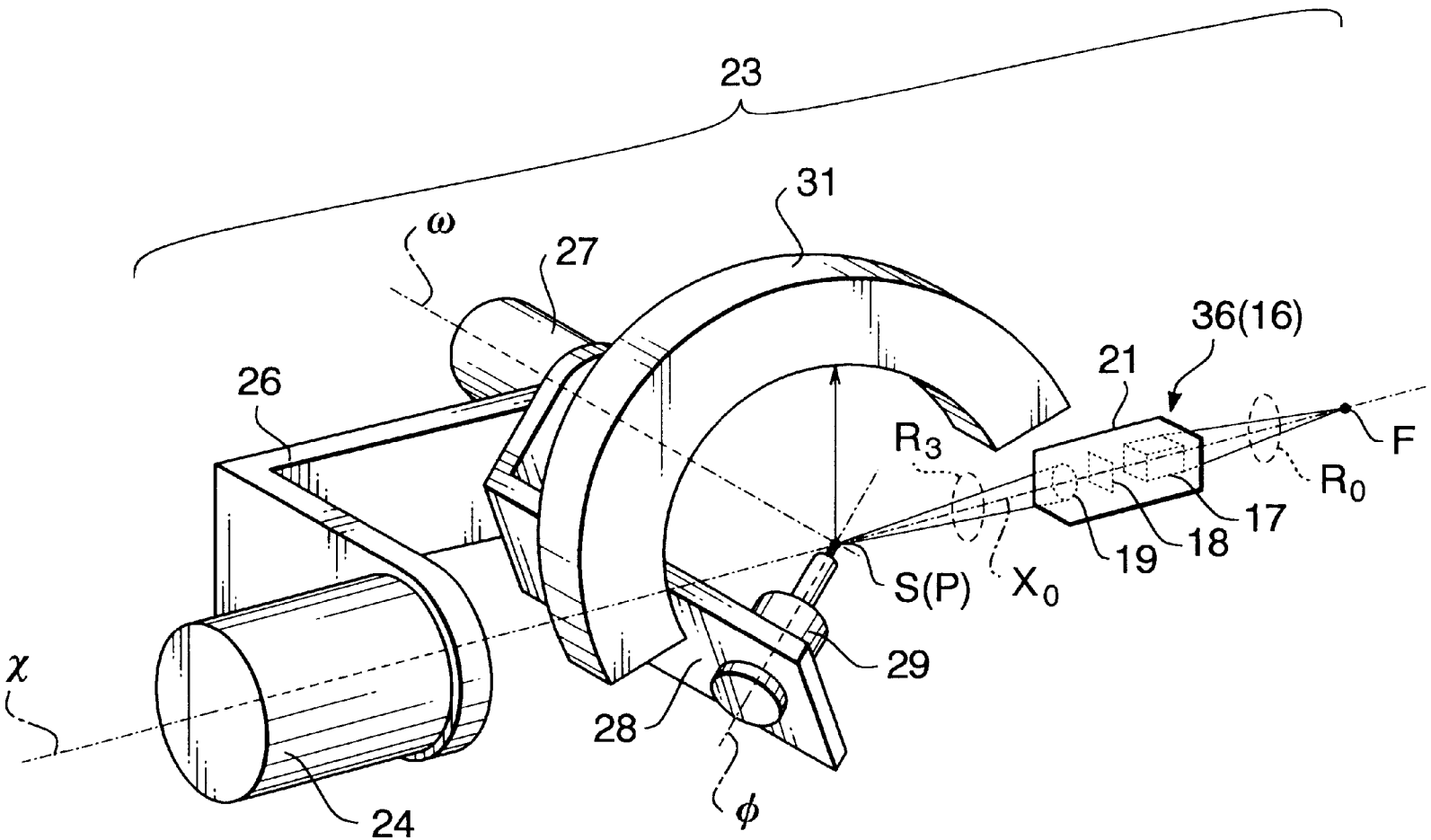
FIG. 5 is a perspective view of an embodiment of an X-ray apparatus constructed with the X-ray condenser of the present invention.

FIG. 5 shows an X-ray micro-diffraction apparatus 23, which is a typical example of application of the X-ray condenser according to the present invention. The X-ray micro-diffraction apparatus 23 is used to analyze the crystal structure of a micro-specimen by irradiating a micro-portion of a specimen or a micro-specimen with X-ray and detecting diffracted X-ray produced in the micro-portion of the specimen, etc.

In the X-ray micro-diffraction apparatus 23, a $\chi$ axis line is set such that it coincides with a center axis line of X-ray generated from an X-ray source F, that is, the X-ray axis X0 and a $\chi$ rotation device 24 is provided on the $\chi$ axis line. The $\chi$ rotation device 24 rotatably drives a $\chi$ arm 26 about the $\chi$ axis line. The $\chi$ arm 26 supports an $\omega$ rotation device 27, which rotatably drives an $\omega$ arm 28 about an $\omega$ axis line. The $\omega$ axis line is orthogonal to the x axis line, that is, the X-ray axis X0.

The $\omega$ arm 28 supports a $\phi$ rotation device 29, which rotates a specimen S about the $\phi$ axis line, that is, the $\phi$ rotation device 29 rotates the specimen S in a plane. The $\phi$ axis line is contained in a plane, which contains the X-ray axis X0 and is orthogonal to the $\omega$ axis line, and passes through a cross point of the $\omega$ axis line and the $\chi$ axis line. The specimen S is provided at a cross point of the $\chi$ axis line, the $\omega$ axis line and the $\phi$ axis line, which is an irradiation position of an X-ray R3.

An X-ray condenser 36 is provided between the X-ray source F and the specimen S. the X-ray condenser 36 functions to condense the X-ray R0 diverging from the X-ray source F to a micro-spot P, which is coincides with a measuring point of the specimen S. The X-ray condenser 36 can be the same as the X-ray condenser 16 shown in FIG. 1.

In FIG. 5, a bent PSPC (Position Sensitive Proportional Counter) 31 is provided in a position remote suitably from the specimen S, as an X-ray detector. The PSPC 31 has a position resolution in a center line direction of a PC (Proportional Counter) by detecting a difference in pulse time between opposite ends of the center wire of the PC. In the case shown in FIG. 5, the position resolution is given in a straight direction in a plane orthogonal to the $\omega$ axis line, so that X-rays having different diffraction angles in that straight direction can be detected simultaneously.

In the X-ray micro-diffraction apparatus having construction mentioned above, due to the rotation of the specimen S separately about the $\chi$ axis line and the $\phi$ axis line, it is possible to make preferred orientation of crystal in disorder condition at the irradiation point of the X-ray R3. Thus, X-rays diffracted at crystal particles are detected by PSPC 31 without omission.

Rotation of the specimen S around the $\omega$ axis line is performed in order to adjust an incident angle of X-rays incident on the specimen S and, after the incident angle is set to a predetermined value, for example, 20° to 30°, the position of the specimen S around the $\omega$ axis line is fixed.

When the X-ray condenser 36 used in the X-ray micro-diffraction apparatus 23 is the same as the X-ray condenser 16 shown in FIG. 1, it is possible to form a well defined, very small X-ray condensing spot P on a micro-point of the specimen S, as described previously with respect to FIG. 1. Therefore, it is possible to obtain diffracted X-ray information with high spatial resolution from the micro-portion of the specimen S.

Incidentally, in the apparatus shown in FIG. 5, the $\chi$ axis line is set such that it coincides with the X-ray axis X0 and the $\omega$ rotation system is mounted on the $\chi$ rotation system. However, the X-ray micro-diffraction apparatus is not limited to such structure and it is possible to mount the $\chi$ rotation system on the $\omega$ rotation system so that the $\chi$ axis line is not always coincident with the X-ray axis X0.

Third Embodiment

Figure 6:
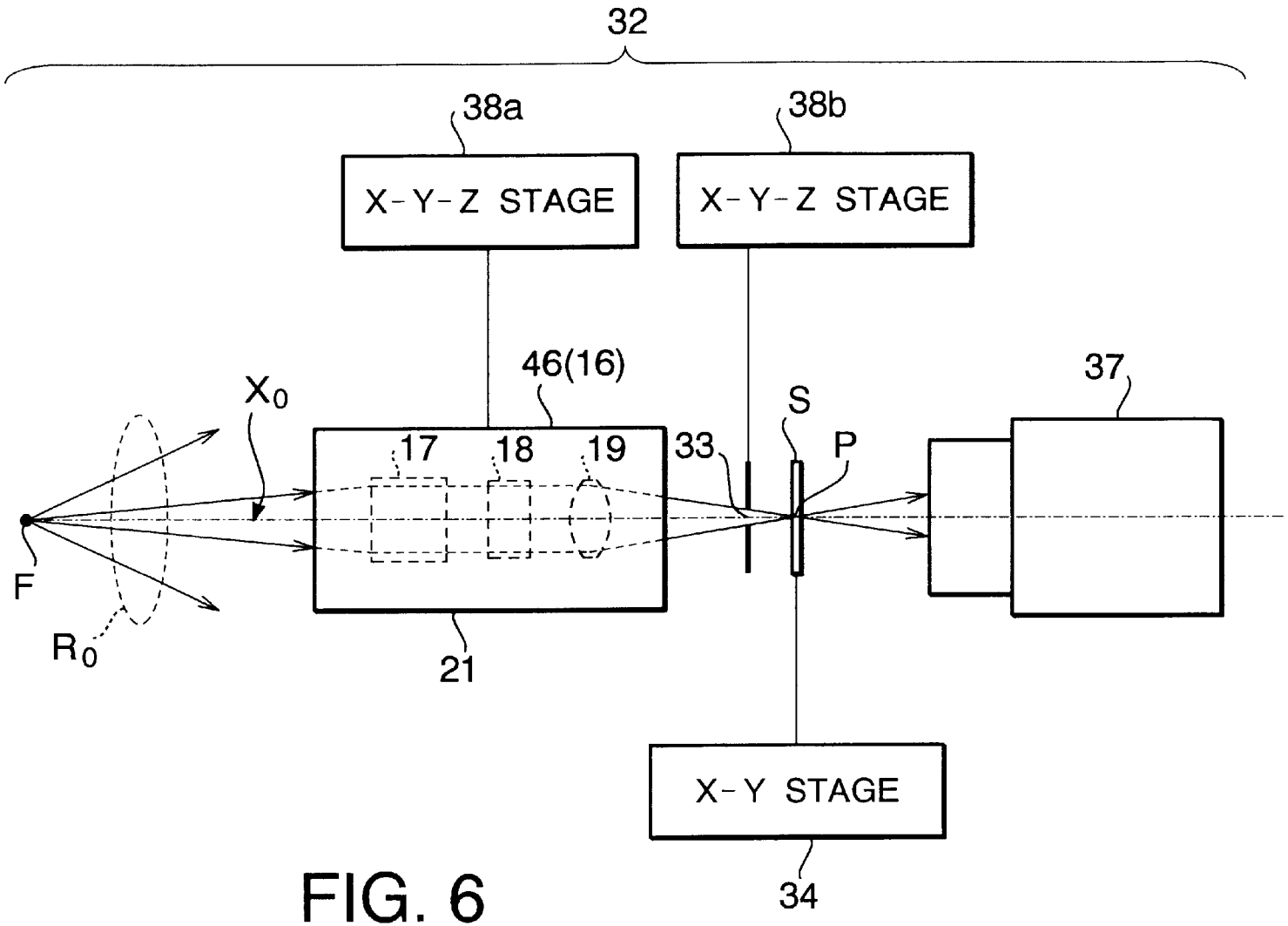
FIG. 6 is a perspective view of another embodiment of an X-ray apparatus constructed with the X-ray condenser of the present invention.

FIG. 6 shows an X-ray microscope 32, which is another typical example of application of the X-ray condenser according to the present invention. The X-ray microscope 32 is used to monitor a micro-specimen such as a microorganism by irradiating the micro-specimen with X-ray and measuring X-ray value absorbed by the specimen.

The X-ray microscope 32 includes an X-ray condenser 46 for condensing X-rays diverging from an X-ray source F to a condensing spot P, a pinhole 33, an XY stage 34 for supporting a specimen S and a PC 37 as an X-ray detector.

For example, the X-ray condenser 46 may be the same as the X-ray condenser 16 shown in FIG. 1. Further, the X-ray condenser 46 and the pinhole 33 are supported by XYZ stages 38*a* and 38*b*, which can move an object in parallel in mutually orthogonal three axes, respectively.

X-rays diverging from the X-ray source F are condensed to the micro-condensing spot P on the specimen S by the X-ray condenser 46, while restricting unnecessary components such as scattered radiation by the pin-hole 33. X-rays passed through the specimen S are detected by the PC 37 and the value of X-ray absorption is obtained on the basis of the result of detection.

The specimen S is moved in a plane orthogonal to the X-ray axis X0 by the XY stage 34 so that the specimen S is swept by a thin X-ray beam. In this case, the spatial resolution of the X-ray microscope depends upon the size of the sweeping X-ray beam. When the X-ray condenser 16 shown in FIG. 1 is used as the X-ray condenser 46, it is possible to condense intense X-ray to the very small condensing spot P to thereby obtain a measuring result of the X-ray microscope with very high spatial resolution.

Other Embodiments

Although the present invention has been described with reference to the preferred embodiments, this description is not meant to be construed in a limiting sense. Various modifications of the disclosed embodiments will become apparent to persons skilled in the art upon reference to the description of the invention. It is therefore contemplated that the appended claims will cover any modifications or embodiments as fall within the true scope of the invention.

For example, although the X-ray condenser 16 shown in FIG. 1 is used in the X-ray micro-diffraction apparatus 23 shown in FIG. 4 and the X-ray microscope 32 shown in FIG. 6, the X-ray condenser according to the present invention can be applied to other arbitrary apparatuses utilizing X-ray.

What is claimed is:

1. An X-ray condenser for condensing X-rays radiated from an X-ray source, comprising:

parallel beam forming means for forming X-rays radiated from said X-ray source to parallel X-ray beams;

a zone plate provided on a downstream side of said parallel beam forming means in a propagating direction of the X-rays and constructed by alternately arranging a plurality of X-ray transmitting bands and X-ray shielding bands; and an analyzing crystal provided between said parallel beam forming means and said zone plate, for selecting X-rays having a specific wavelength from X-rays containing a plurality of X-ray components having different wavelengths.

2. An X-ray condenser as claimed in claim 1, further comprising a casing for air-tighly enclosing said parallel beam forming means and said zone plate and evacuation means for discharging air in said casing.

3. An X-ray condenser as claimed in claim 1, wherein said parallel beam forming means is parabolic parallel beam forming means having parabolic surfaces, for forming diverging X-ray beams to parallel X-ray beams either horizontally or vertically by utilizing said parabolic surfaces.

4. An X-ray condenser as claimed in claim 1, wherein said parallel beam forming means is parabolic parallel beam forming means having a pair of parabolic surfaces juxtaposed with each other, for forming diverging X-ray beams to parallel X-ray beams both horizontally and vertically by utilizing said parabolic surfaces.

5. An X-ray condenser as claimed in claim 3, wherein said parallel beams forming means is a parabolic reflection mirror capable of reflecting X-ray by a parabolic surface or a parallel multi-layered film mirror capable of diffracting X-ray by a multi-layered film formed on a parabolic surface thereof.

6. An X-ray condenser as claimed in claim 4, wherein said parallel beam forming means is a parabolic reflection mirror capable of reflecting X-ray by a parabolic surface or a parallel multi-layered film mirror capable of diffracting X-ray by a multi-layered film formed on a parabolic surface thereof.

7. An X-ray condenser as claimed in claim 4, wherein said X-ray source is a point focus X-ray source having an X-ray focus point having an area defined by a horizontal side length substantially the same as a vertical side length.

8. An X-ray diffraction apparatus including an X-ray source, an X-ray condenser for condensing X-rays radiated from said X-ray source to a micro-point of a specimen or a micro-specimen and X-ray detection means for detecting X-rays from said specimen, wherein said X-ray condenser comprises:

parallel beam forming means for forming X-rays radiated from said X-ray source to parallel X-ray beams;

a zone plate provided on a downstream side of said parallel beam forming means in a propagating direction of the X-rays and constructed by alternately arranging a plurality of X-ray transmitting bands and X-ray shielding bands; and an analyzing crystal provided between said parallel beam forming means and said zone plate, for selecting X-rays having a specific wavelength from X-rays containing a plurality of X-ray components having different wavelengths.

9. An X-ray diffraction apparatus as claimed in claim 8, further comprising a casing for air-tightly enclosing said parallel beam forming means and said zone plate and evacuation means for discharging air in said casing.

10. An X-ray diffraction apparatus as claimed in claim 8, wherein said parallel beam forming means is parabolic parallel beam forming means having parabolic surfaces, for forming diverging X-ray beams to parallel X-ray beams either horizontally or vertically by utilizing said parabolic surfaces.

11. An X-ray diffraction apparatus as claimed in claim 8, wherein said parallel beam forming means is parabolic parallel beam forming means having a pair of parabolic surfaces juxtaposed with each other, for forming diverging X-ray beams to parallel X-ray beams both horizontally and vertically by utilizing said parabolic surfaces.

12. An X-ray diffraction apparatus as claimed in claim 10, wherein said parallel beam forming means is a parabolic reflection mirror capable of reflecting X-rays by a parabolic surface or a parallel multi-layered film mirror capable of diffracting X-rays by a multi-layered film formed on a parabolic surface thereof.

13. An X-ray diffraction apparatus as claimed in claim 11, wherein said parallel beam forming means is a parabolic reflection mirror capable of reflecting X-rays by a parabolic surface or a parallel multi-layered film mirror capable of diffracting X-rays by a multi-layered film formed on a parabolic surface thereof.

14. An X-ray diffraction apparatus as claimed in claim 11, wherein said X-ray source is a point focus X-ray source having an X-ray focus point having an area defined by a horizontal side length substantially the same as a vertical side length.

* * * * *